US008801470B2

(12) United States Patent
Hsueh

(10) Patent No.: US 8,801,470 B2
(45) Date of Patent: Aug. 12, 2014

(54) ELECTRICAL CONNECTOR AND ASSEMBLING METHOD THEREOF

(71) Applicant: ANT Precision Industry Co., Ltd, Taipei (TW)

(72) Inventor: Chih-Yu Hsueh, Taipei (TW)

(73) Assignee: ANT Precision Industry Co., Ltd, Neihu Dist., Taipei (TW)

( * ) Notice: Subject to any disclaimer, the term of this patent is extended or adjusted under 35 U.S.C. 154(b) by 0 days.

(21) Appl. No.: 13/664,423

(22) Filed: Oct. 31, 2012

(65) Prior Publication Data

US 2013/0178105 A1 Jul. 11, 2013

Related U.S. Application Data

(60) Provisional application No. 61/583,218, filed on Jan. 5, 2012.

(51) Int. Cl.
*H01R 24/00* (2011.01)

(52) U.S. Cl.
USPC ..... 439/660; 439/607.01

(58) Field of Classification Search
USPC ..... 439/79, 607.01, 607.25, 607.4, 439/607.54–607.56, 660
See application file for complete search history.

(56) References Cited

U.S. PATENT DOCUMENTS

| | | | | |
|---|---|---|---|---|
| 7,625,243 | B2 | 12/2009 | Chen | |
| 7,833,065 | B2 | 11/2010 | Lin | |
| 7,938,659 | B1 * | 5/2011 | Zhu et al. | 439/218 |
| 7,988,495 | B2 | 8/2011 | Chung | |
| 8,075,345 | B2 * | 12/2011 | Peng | 439/660 |
| 8,323,057 | B2 * | 12/2012 | Ho | 439/660 |
| 8,382,519 | B2 * | 2/2013 | Lin et al. | 439/607.01 |
| 8,568,173 | B2 * | 10/2013 | Wu | 439/607.56 |
| 8,597,060 | B2 * | 12/2013 | Wu | 439/660 |

FOREIGN PATENT DOCUMENTS

| | | |
|---|---|---|
| TW | M357748 | 5/2009 |
| TW | M391203 | 10/2010 |
| TW | M394623 | 12/2010 |
| TW | M406299 | 6/2011 |
| TW | M406842 | 7/2011 |

* cited by examiner

*Primary Examiner* — Thanh Tam Le
(74) *Attorney, Agent, or Firm* — Winston Hsu; Scott Margo

(57) ABSTRACT

The present disclosure relates to an electrical connector and an assembling method thereof. The electrical connector includes a first insulating housing, a step-shaped second insulating housing, a plurality of first contacts, a plurality of second contacts, and a plurality of third contacts. The first and third contacts are exposed over the second insulating housing and face the same direction. The second contacts are exposed over the second insulating housing and face an opposite direction. The exposed first, second, and third contacts are capable of being soldered to a transmission cable.

12 Claims, 12 Drawing Sheets

ELECTRICAL CONNECTOR AND ASSEMBLING METHOD THEREOF

CROSS REFERENCE TO RELATED APPLICATIONS

This application claims the benefit of U.S. Provisional Application No. 61/583,218, filed on Jan. 5, 2012 and entitled "ELECTRICAL CONNECTOR" the contents of which are incorporated herein.

BACKGROUND OF THE INVENTION

1. Field of the Invention

The present invention relates to a connector and an assembling method thereof, and, more particularly, to a receptacle connector and an assembling method thereof.

2. Description of the Prior Art

A receptacle connector is widely utilized to be a datum transmission tool. The embodiment of the conventional receptacle connector includes an USB connector and a SATA connector. A compound receptacle connector is disclosed in TW patent publication No. M357748. The compound connector is used for a standard of USB 2.0, USB 3.0 and SATA connector. The receptacle connector comprises three different types of terminals. In addition, the receptacle connector is fixed on a circuit board.

Besides, a wire-soldered connector is disclosed in TW patent publication No. M391203. The wire-soldered connector includes a plurality of first solder cups and a plurality of second solder cups. The first solder cups face the direction opposite to the direction which the second solder cups face. After the transmission cable is soldered to the first solder cups, the wire-soldered connector is turned over, and then the transmission cable is further soldered to the second solder cups. Besides, the signal wire, the power wire and the grounding wire respectively soldered to the differential signal terminal, the power terminal and the grounding terminal are encompassed as a cable.

SUMMARY OF THE INVENTION

The present invention provides a receptacle connector and an assembling method thereof. The receptacle connector can be assembled with a transmission cable for the convenience to move the receptacle connector to the suitable operation position.

According to the claimed invention, the electrical connector includes a first insulating housing, a second insulating housing, a plurality of first contacts, a plurality of second contacts and a plurality of third contacts. The first insulating housing includes a plurality of first accommodating slots, a plurality of second accommodating slots and a plurality of third accommodating slots. The second insulating housing includes a central portion. An edge of the central portion is a step-shaped structure. The central portion includes a plurality of first terminal slots respectively connected to the first accommodating slots, a plurality of second terminal slots respectively connected to the second accommodating slots, a plurality of third terminal slots respectively connected to the third accommodating slots, and a plurality of sunken slots respectively connected to the third terminal slots. The first insulating housing is accommodated in the second insulating housing.

According to the claimed invention, the first contacts are respectively accommodated in the first accommodating slots and the first terminal slots. The first contacts includes a pair of first differential signal terminals. Each first contact includes a first assembling portion, a first contact portion connected to an end of the first assembling portion, and a first soldering portion connected to the other end of the first assembling portion.

According to the claimed invention, the second contacts are respectively accommodated in the second accommodating slots and the second terminal slots. The second contacts include a pair of second differential signal terminals and a pair of third differential signal terminals. Each second contact includes a second assembling portion, a second contact portion connected to an end of the second assembling portion, and a second soldering portion connected to the other end of the second assembling portion.

According to the claimed invention, the third contacts are respectively accommodated in the third accommodating slots, the third terminal slots and the sunken slots. The third contacts include a pair of fourth differential signal terminals and a pair of fifth differential signal terminals. Each third contact includes a third assembling portion, a third contact portion connected to an end of the third assembling portion, and a third soldering portion connected to the other end of the third assembling portion.

According to the claimed invention, the second insulating housing further includes a pair of stretch portions preferably. The stretch portions stretch from the other edge of the central portion for accommodating the first insulating housing.

According to the claimed invention, an assembling method of the electrical connector includes:

disposing the second contacts in the first insulating housing in an insert molding method;

placing the first insulating housing in a pair of the stretch portions of the second insulating housing;

disposing the first contacts and the third contacts in the second insulating housing;

placing the first insulating housing, the second insulating housing, the first contacts, the second contacts and the third contacts in an accommodating space of a metal case;

soldering a plurality of first signal cables, a first grounding cable and a power cable of a first cable set to the first soldering portions;

soldering a plurality of second signal cables and a plurality of second grounding cables of a second cable set to the second soldering portions, wherein the second grounding cables are soldered to the same second soldering portion; and soldering a plurality of third signal cables, a plurality of third grounding cables and a grounding component of a third cable set to the third soldering portions, wherein one of the soldering pins and one of the third grounding cable are soldered to the same third soldering portion.

The receptacle connector of the present disclosure can be connected to the transmission cable. Therefore, the electrical connector can be movable to be disposed on a working plane for preferred benefit according to user's demand.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
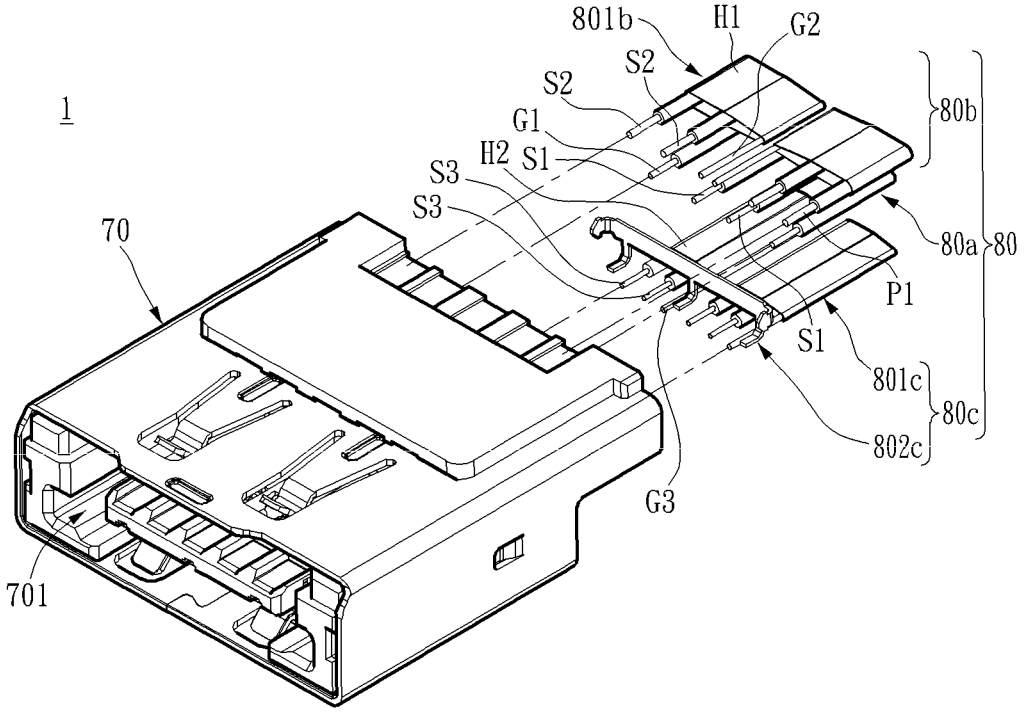
FIG. 1A and FIG. 1B are assembly diagrams of an electrical connector of the present disclosure.

Please refer to FIG. 1A to FIG. 2A. An electrical connector 1 of the present disclosure includes a first insulating housing 10, a second insulating housing 20, a plurality of first contacts 40, a plurality of second contacts 50 and a plurality of third contacts 60.

Figure 3A:
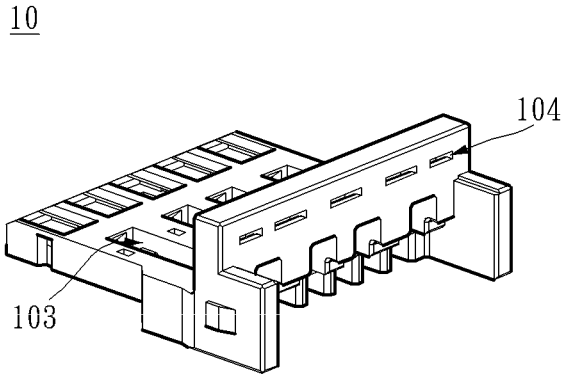
FIG. 3A and FIG. 3B are assembly diagrams of a first insulating housing of the present disclosure.
Figure 3B:
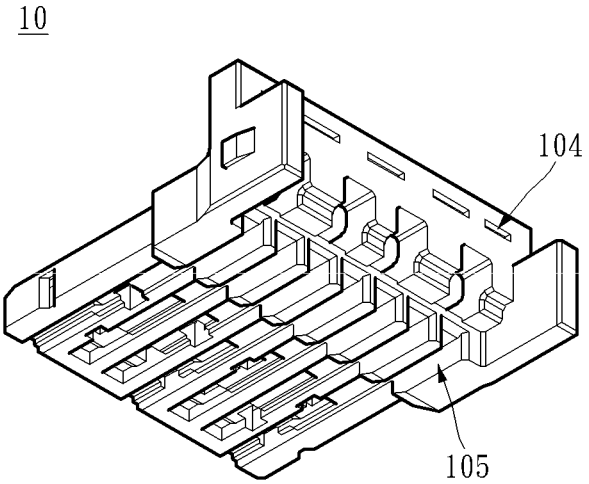

Please refer to FIG. 3A and FIG. 3B. The first insulating housing 10 includes a plurality of first accommodating slots 103, a plurality of second accommodating slots 104 and a plurality of third accommodating slots 105.

Figure 1B:
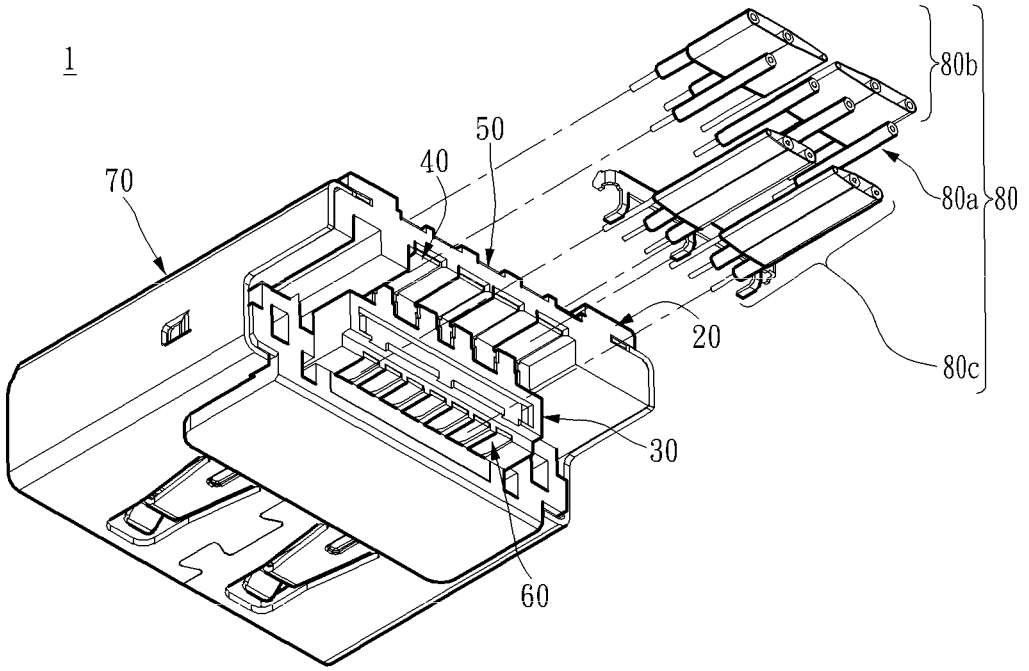
Figure 4A:
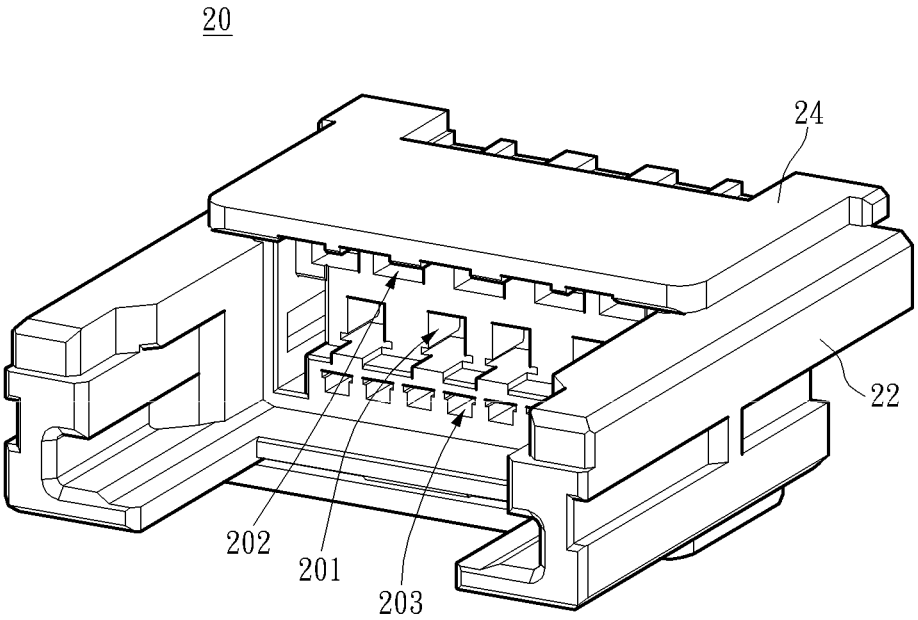
FIG. 4A and FIG. 4B are assembly diagrams of a second insulating housing of the present disclosure.
Figure 4B:
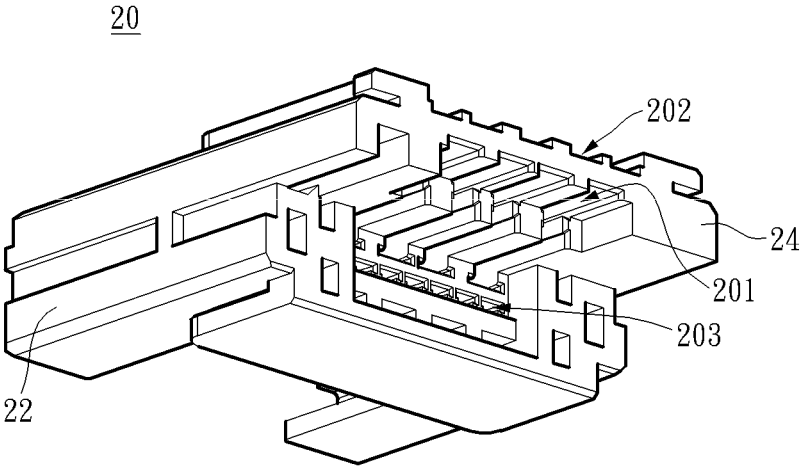

An edge of the second insulating housing 20 (not shown in figures) is a step-shaped structure. The second insulating housing 20 preferably includes at least one stretch portion 22, a central portion 24 and a rear cover 30. Please refer to FIG. 4A and FIG. 4B. The rear cover 30 can be engaged with the central portion 24 of the second insulating housing 20, so as to form the step-shaped structure. As shown in FIG. 1B, in an embodiment of the present disclosure, the second insulating housing 20 includes a pair of stretch portions 22 respectively stretching from two sides of the central portion 24, so that the first insulating housing 10 is easily accommodated in the second insulating housing 20. The central portion 24 includes a plurality of first terminal slots 201 respectively connected to the first accommodating slots 103, a plurality of second terminal slots 202 respectively connected to the second accommodating slots 104, and a plurality of third terminal slots 203 respectively connected to the third accommodating slots 105.

Figure 5:
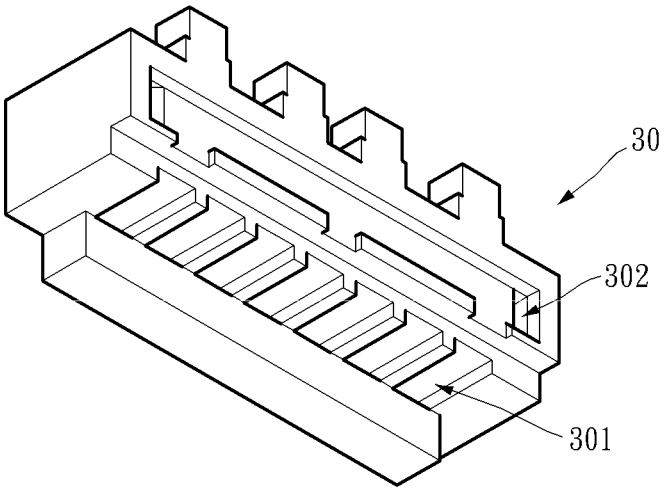
FIG. 5 is an assembly diagram of a rear cover of the present disclosure.

Please refer to FIG. 5. The rear cover 30 includes a plurality of sunken slots 301 and at least one fixing hole 302. The sunken slots 301 are respectively connected to the third terminal slots 203.

Figure 2A:
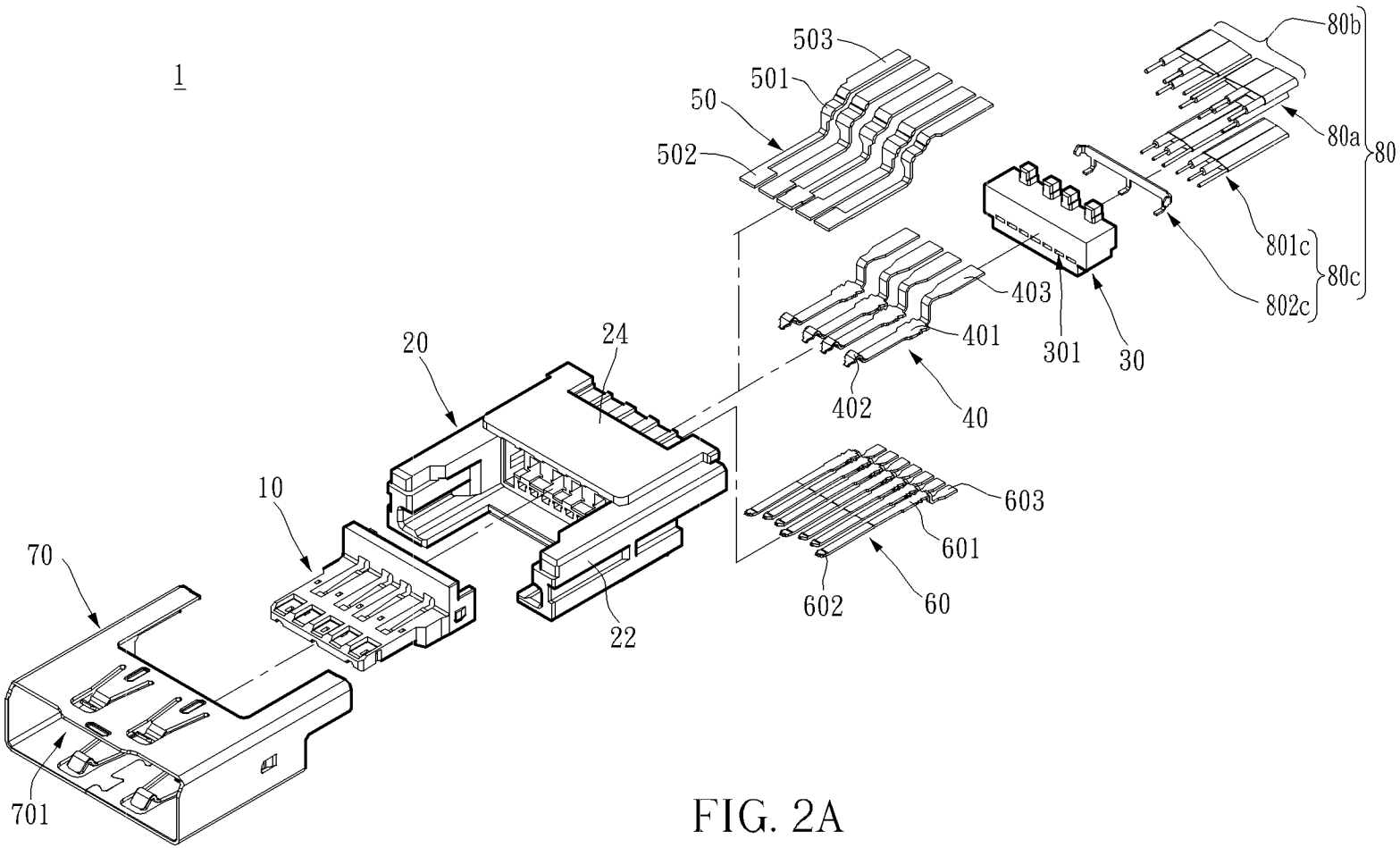
FIG. 2A is an exploded diagram of the electrical connector of the present disclosure.
Figure 2B:
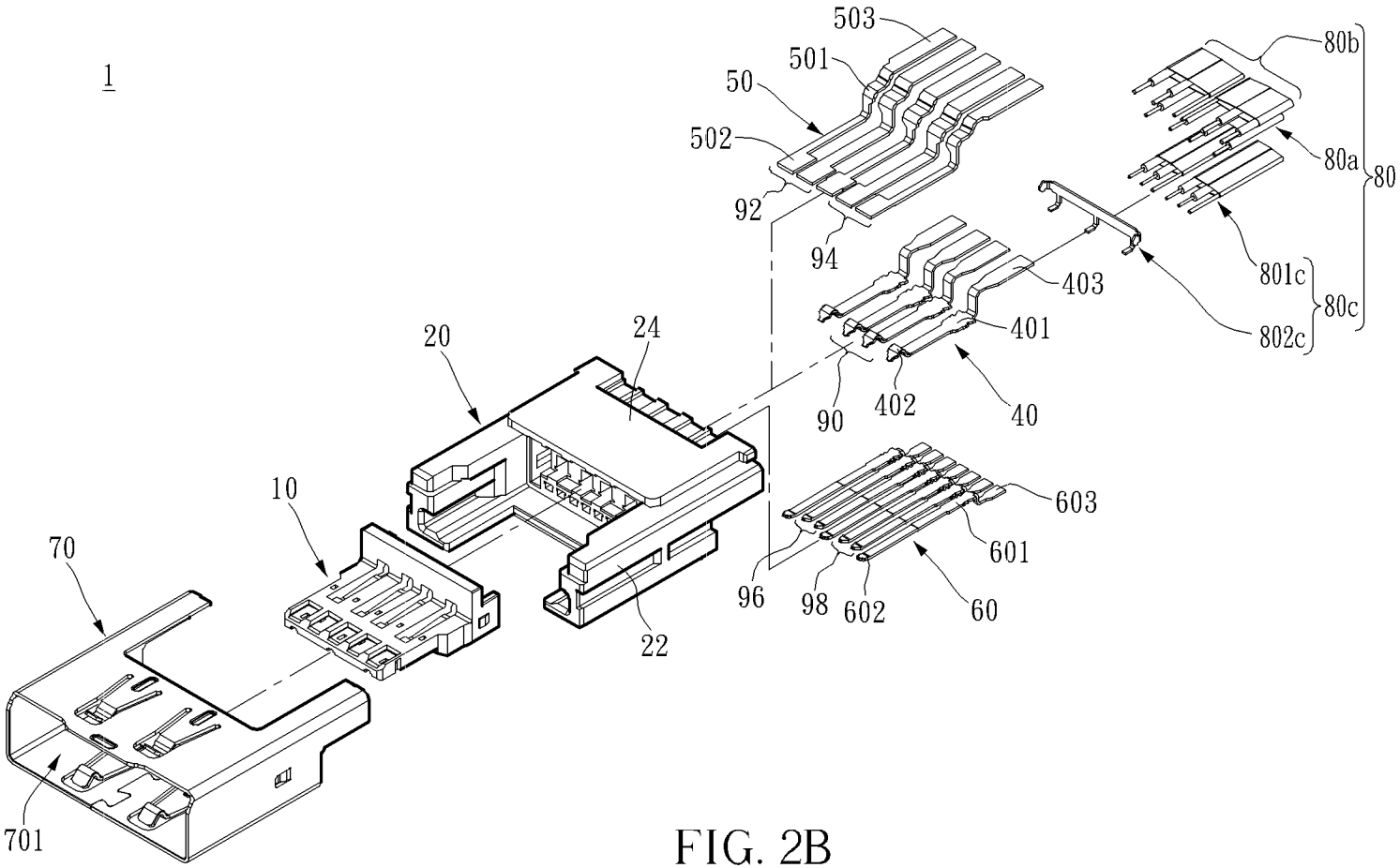
FIG. 2B is an exploded diagram of the electrical connector without a rear cover of the present disclosure.

The first contacts 40 are respectively accommodated in the first accommodating slots 103 and the first terminal slots 201. The first contact 40 is compatible with a USB 2.0 transmission cable. As shown in FIG. 2B, the first contacts 40 include a pair of first differential signal terminals 90, a power cable (not shown in figures) and a grounding cable (not shown in figures). Each first contact 40 includes a first assembling portion 401, a first contact portion 402 connected to an end of the first assembling portion 401, and a first soldering portion 403 connected to the other end of the first assembling portion 401. The first soldering portions 403 are respectively accommodated in the central portion 24 and are exposed over the first terminal slots 201.

The second contacts 50 are respectively accommodated in the second accommodating slots 104 and the second terminal slots 202. The second contacts 50 and the first contacts 40 can conform to a transmission cable with USB 3.0 specification. As shown in FIG. 2A, the second contacts 50 include a pair of second differential signal terminals 92, a pair of third differential signal terminals 94, and a grounding cable (not shown in figures). Each second contact 50 includes a second assembling portion 501, a second contact portion 502 connected to an end of the second assembling portion 501, a second soldering portion 503 connected to the other end of the second assembling portion 501. The second soldering portions 503 are respectively accommodated in the central portion 24 and are exposed over the second terminal slots 202.

The third contacts 60 are respectively accommodated in the third accommodating slots 105, the third terminal slots 203 and the sunken slots 301. The third contact 60 can conform to a transmission cable with SATA specification. As shown in FIG. 2A, the third contacts 60 include a pair of fourth differential signal terminals 96, a pair of fifth differential signal terminals 98, and three grounding cables (not shown in figures). Each third contact 60 includes a third assembling portion 601, a third contact portion 602 connected to an end of the third assembling portion 601, and a third soldering portion 603 connected to the other end of the third assembling portion 601. The third soldering portions 603 are respectively accommodated in the rear cover 30 and are exposed over the sunken slots 301. The electrical connector 1 further includes a metal case 70, which has an accommodating space 701 for accommodating the first insulating housing 10, the second insulating housing 20, the first contacts 40, the second contacts 50 and the third contacts 60.

Figure 8:
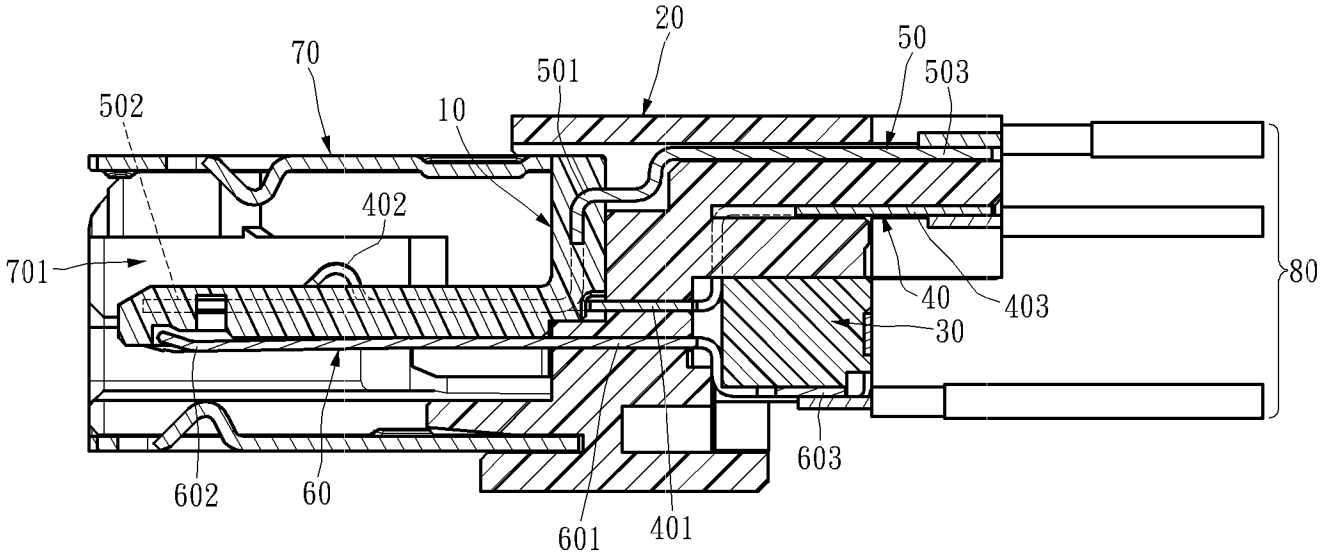
FIG. 8 is a sectional view along B-B line shown in FIG. 7.

As shown in FIG. 1B and FIG. 8, the first contacts 40, the second contacts 50 and the third contacts 60 are exposed at an edge of the step-shaped structure of the second insulating housing 20. It is to say, the first soldering portion 403 and the third soldering portion 603 are respectively exposed over the first terminal slots 201 and the sunken slots 301 by facing the same direction, the second soldering portion 503 is exposed over the second terminal slots 202 in the direction opposite to the above one.

Figure 9:
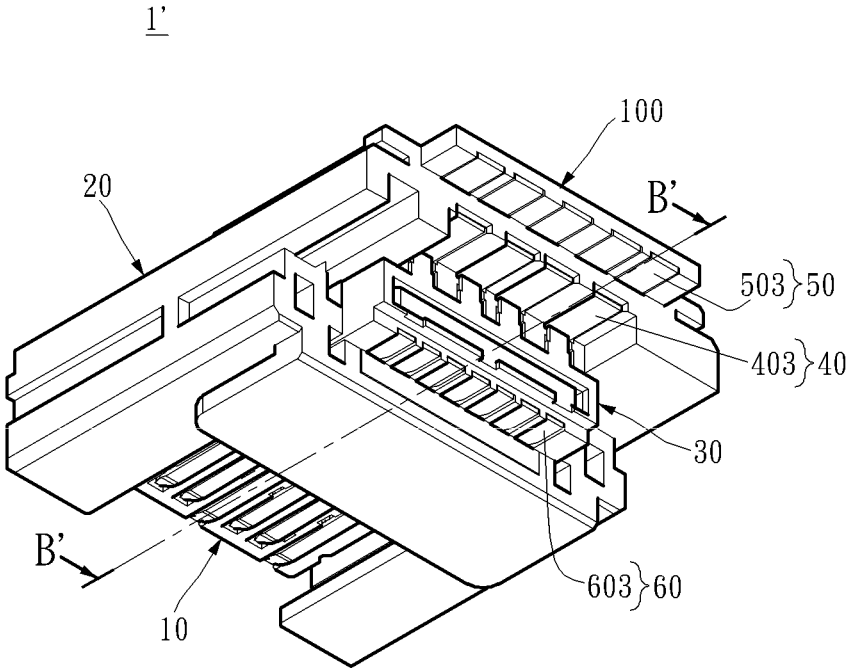
FIG. 9 is an assembly diagram of an electrical connector according to the other embodiment of the present disclosure.
Figure 10:
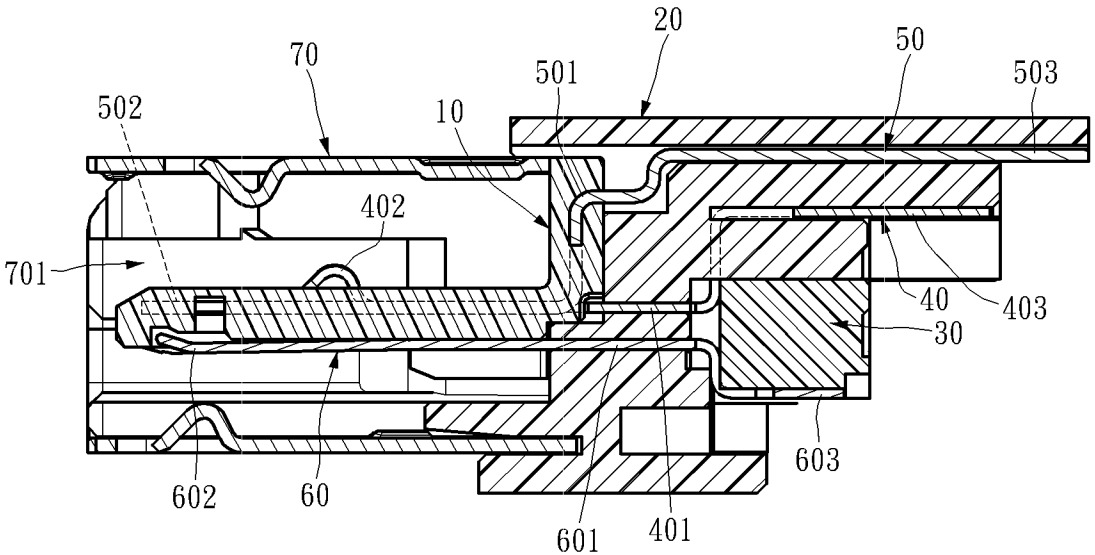
FIG. 10 is a sectional view along B'-B' line shown in FIG. 9.

In the other embodiment, as shown in FIG. 9 and FIG. 10, the electrical connector 1' can further include a protrusion 100 disposed on an end of the central portion 24 opposite the first insulating housing 10. The second soldering portions 502 are exposed over the protrusion 100. Therefore, the first soldering portion 403, the second soldering portion 503 and the third soldering portion 603 are respectively exposed over the first terminal slot 201, the protrusion 100 and the sunken slot 304 by facing the same direction.

As shown in FIG. 2B, the rear cover 30 can be omitted in the other embodiment. The first soldering portions 403 are respectively exposed over the first terminal slots 201, the second soldering portions 503 are respectively exposed over the second terminal slots 202, and the third soldering portions 603 are respectively accommodated in the third terminal slots 203 and protrude from the second insulating housing 20.

The first contacts 40, the second contacts 50 and the third contacts 60 can be connected to a transmission cable 80 in soldering method. The transmission cable 80 includes a first cable set 80*a*, a second cable set 80*b* and a third cable set 80*c*. Detailed description of each cable set is introduced as following.

The first cable set 80*a* includes a pair of first signal cables S1, a first grounding cable G1 and a power cable P1. The first signal cable, the first grounding cable G1 and the power cable P1 are respectively soldered to the corresponding first soldering portions 403.

The second cable set 80*b* includes a pair of internal cable sets 801*b*. Each internal cable set 801*b* includes a pair of second signal cables S2, a second grounding cable G2 and a shielding layer H1. The shielding layer encompasses the second signal cables S2 and the second grounding cables G2. The second grounding cables are soldered to the same second soldering portion 503. The second signal cables S2 are respectively soldered to the corresponding second soldering portions 503.

Figure 6:
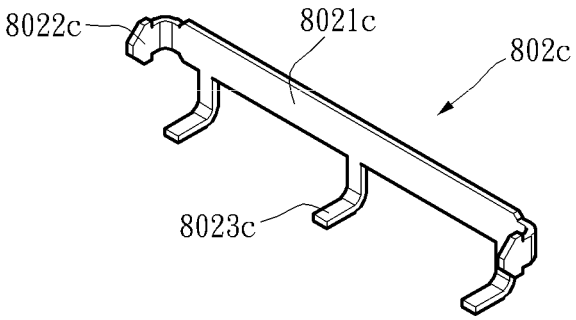
FIG. 6 is an assembly diagram of a grounding component of the present disclosure.
Figure 7:
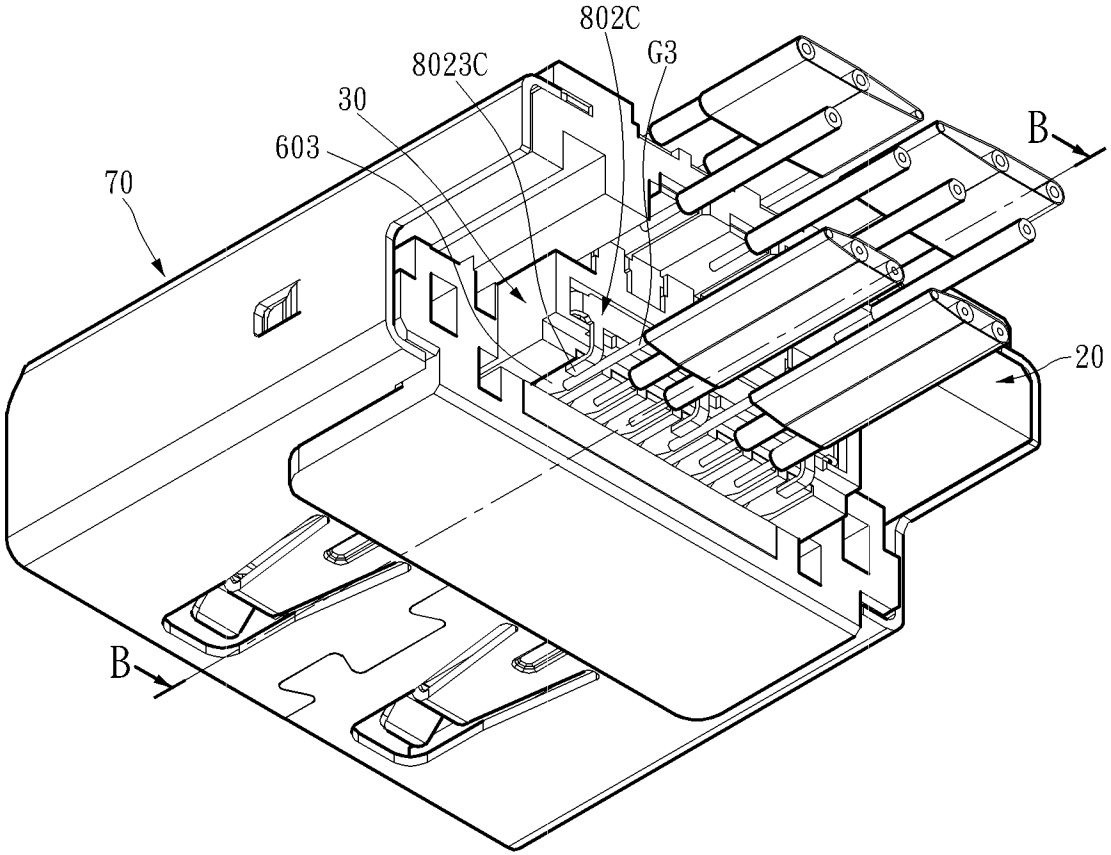
FIG. 7 is another assembly diagram of the electrical connector of the present disclosure.

The third cable set 80*c* includes a pair of internal cable sets 801*c* and a grounding component 802*c*. Each internal cable set 801*c* includes a pair of third signal cables S3, a third grounding cable G3 and a shielding layer H2. The shielding layer encompasses the third signal cables S3 and the third grounding cable G3. Please refer to FIG. 6. The grounding component 802*c* includes a body 8021*c*, at least one fixing portion 8022*c* and a plurality of soldering pins 8023*c*. The fixing portion 8022*c* is disposed at an end of the body 8021*c*, so as to connect the grounding component 802*c* to the rear cover 30. The grounding component 802*c* of the present disclosure can include three soldering pins 8023*c*. Each soldering pin 8023*c* is vertically bent to extend from a side of the body 8021*c*. The third signal cables, the third grounding cable G3 and the pins 8023*c* are respectively soldered to the corresponding third soldering portions 603. As shown in FIG. 7, one of the soldering pins 8023*c* and the third grounding cable G3 and soldered to the same third soldering portion 603.

Figure 2C:
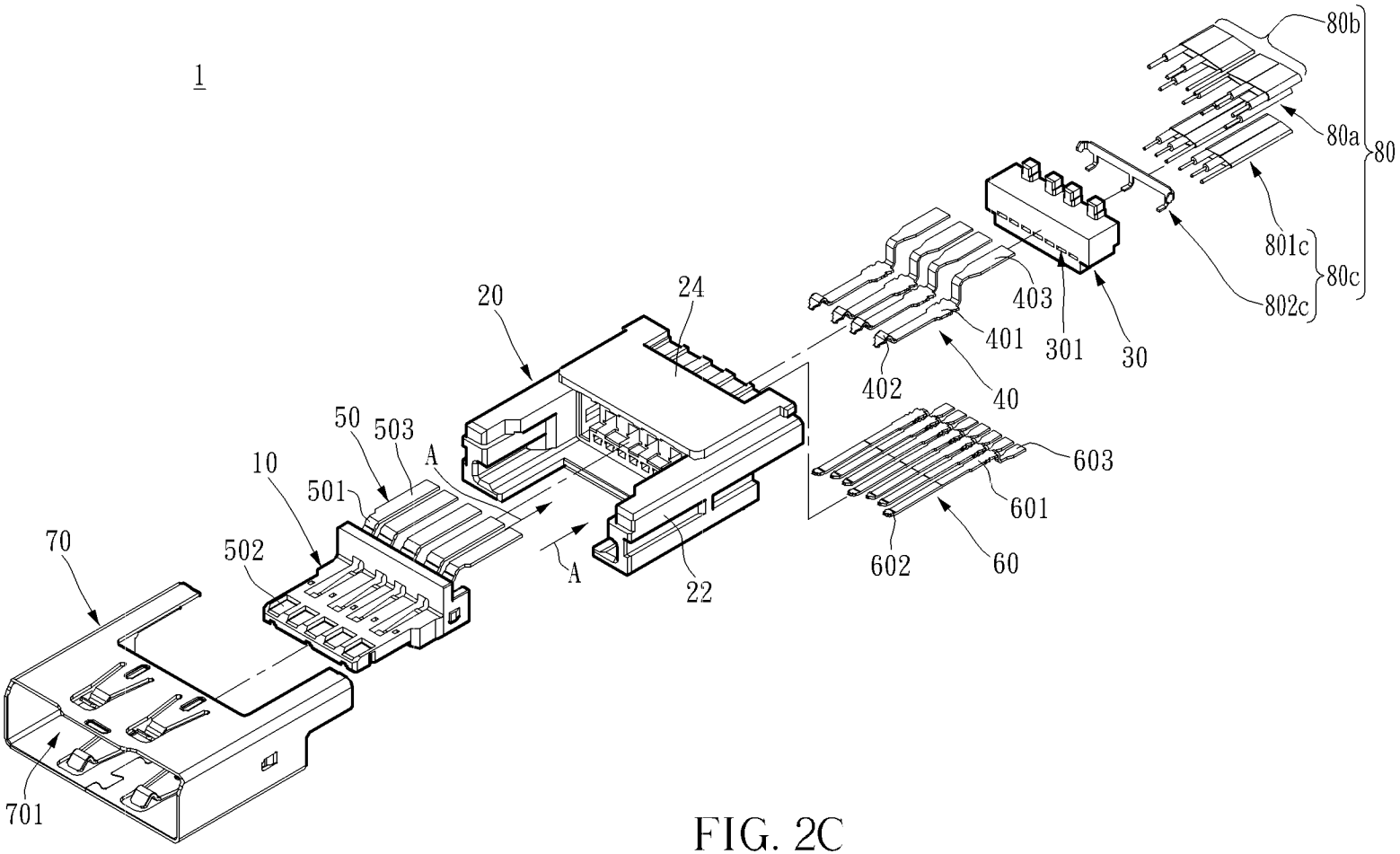
FIG. 2C and FIG. 2D are assembly flows of the electrical connector of the present disclosure.
Figure 2D:
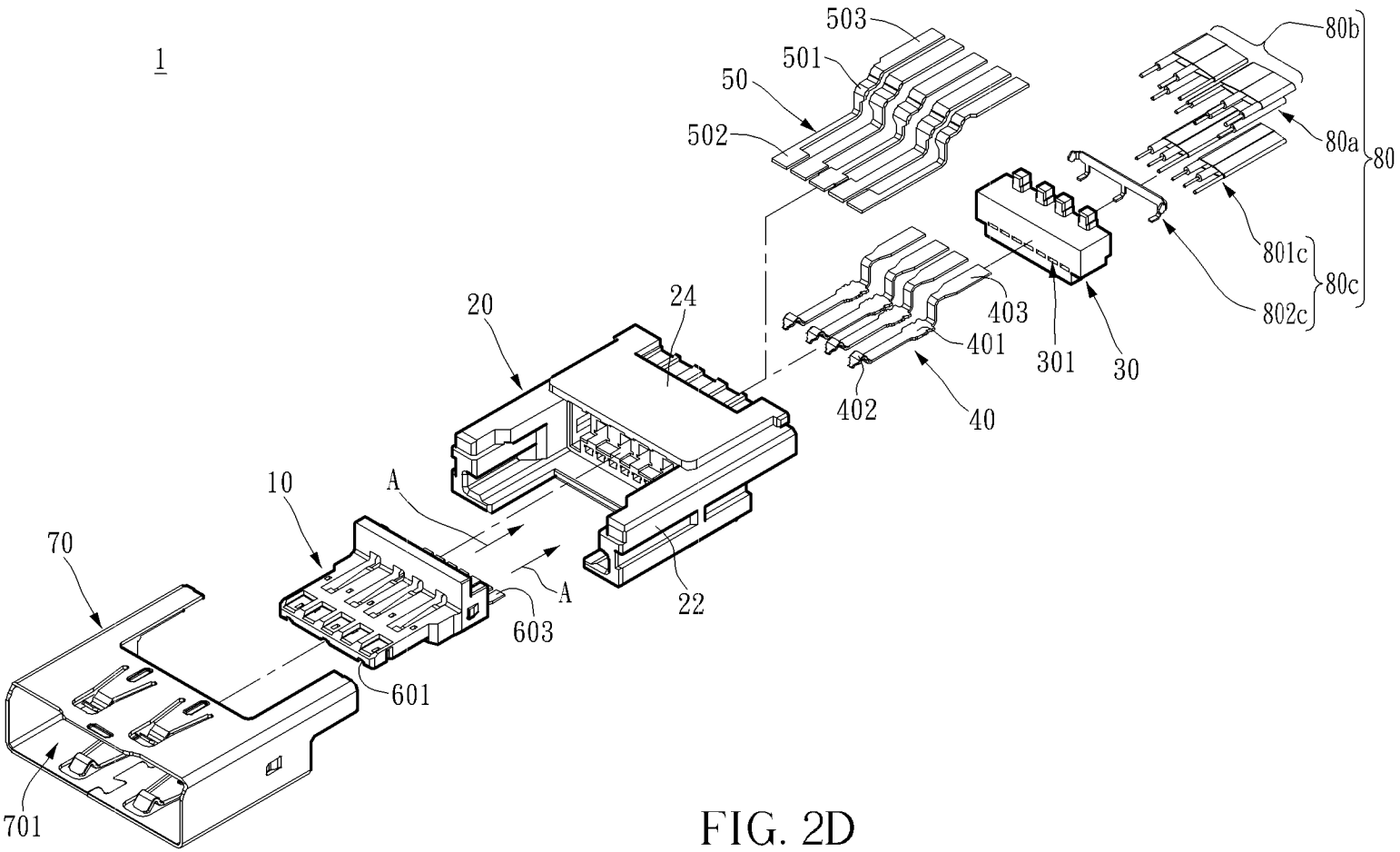

Please refer to FIG. 2C, which provides an assembling method for the electrical connector 1. First, an insert molding method is utilized to dispose the second contacts 50 in the first insulating housing 10. Further, the third contacts 60 can be disposed in the first insulating housing 10 at the beginning, as shown in FIG. 2D.

The following description introduces the assembling method of disposing the second contacts 50 at the beginning, referring to FIG. 2C. After the second contacts 50 are disposed in the first insulating housing 10, the first insulating housing 10 is accommodated in the stretch portions 22 of the second insulating housing 20 (as shown in an arrow A). Then, the first contacts 40 and the third contacts 60 are disposed in the second insulating housing 20. Finally, the first insulating housing 10, the second insulating housing 20, the first contacts 40, the second contacts 50 and the third contacts 60 are accommodated in the metal case 70. In addition, the first soldering portion 403 exposed over the first terminal slot 201, the second soldering portion 503 exposed over the second terminal slot 202, and the third soldering portion 603 exposed over the sunken slot 301 are soldered to the transmission cable 80.

The electrical connector 1 of the present disclosure can be connected to the transmission cable 80. Therefore, the electrical connector 1 can be movable to be disposed on a working plane for preferred benefit according to user's demand.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electrical connector comprising:

a first insulating housing, comprising a plurality of first accommodating slots, a plurality of second accommodating slots and a plurality of third accommodating slots;

a second insulating housing, accommodating the first insulating housing and comprising:

a central portion, with an edge in a step-shaped structure, comprising:

a plurality of first terminal slots correspondingly connected to the first accommodating slots;

a plurality of second terminal slots correspondingly connected to the second accommodating slots;

a plurality of third terminal slots correspondingly connected to the third accommodating slots; and a plurality of sunken slots correspondingly connected to the third terminal slots;

a plurality of first contacts respectively accommodated in the first accommodating slots and the first terminal slots, and the first contacts comprising a pair of first differential signal terminals and each the first differential signal terminals comprising:

a first assembling portion;

a first contact portion connected to an end of the first assembling portion; and a first soldering portion connected to another end of the first assembling portion;

a plurality of second contacts, respectively accommodated in the second accommodating slots and the second terminal slots, and the second contacts, comprising a pair of second differential signal terminals and a pair of third differential signal terminals and each the second contacts comprising:

a second assembling portion;

a second contact portion connected to an end of the second assembling portion; and a second soldering portion connected to another end of the second assembling portion; and a plurality of third contacts, respectively accommodated in the third accommodating slots, the third terminal slots and the sunken slots, comprising a pair of fourth differential signal terminals and a pair of fifth differential signal terminals and each the third contact comprising:

a third assembling portion;

a third contact portion connected to an end of the third assembling portion; and a third soldering portion connected to another end of the third assembling portion;

wherein the first soldering portions and the third soldering portions are respectively exposed over the first terminal slots and the sunken slots in one direction, the second soldering portions are exposed over the second terminal slots in another direction.

2. The electrical connector of claim 1, wherein the electrical connector further comprises a rear cover engaged with the central portion of the second insulating housing, and the rear cover comprises at least one fixing hole, the sunken slots, and exposedly accommodating the third soldering portions.

3. The electrical connector of claim 1, further comprising a metal case with an accommodating space, wherein the first insulating housing, the second insulating housing, the first contacts, the second contacts and the third contacts are accommodated in the accommodating space.

4. The electrical connector of claim 2, further comprising:

a first cable set, comprising two first signal cables, a first grounding cable and a power cable respectively soldered to the first soldering portions;

a second cable set, comprising a first pair of internal cable sets respectively containing two second signal cables, a second grounding cable and a shielding layer encompassing the two second signal cables and the second grounding cable, wherein the second grounding cables are soldered to one of the second soldering portions, and the second signal cables are correspondingly soldered to the second soldering portions;

a third cable set, comprising:

a second pair of internal cable sets, respectively comprising two third signal cables, a third grounding cable and a shielding layer encompassing the two third signal cables and the third grounding cable; and a grounding component, comprising:

a body;

at least one fixing portion disposed at an end of the body; and a plurality of soldering pins vertically bent to extend from a side of the body;

wherein the fixing portion is engaged with the fixing hole in the rear cover, the third signal cables, the third grounding cables and the pins are correspondingly soldered to the third soldering portions, one of the soldering pins and one of the third grounding cables are soldered to one of the third soldering portions.

5. An electrical connector comprising:

a first insulating housing, comprising a plurality of first accommodating slots, a plurality of second accommodating slots and a plurality of third accommodating slots;

a second insulating housing, comprising:

a central portion, with an edge in a step-shaped structure, comprising:

a plurality of first terminal slots correspondingly connected to the first accommodating slots;

a plurality of second terminal slots correspondingly connected to the second accommodating slots;

a plurality of third terminal slots correspondingly connected to the third accommodating slots; and a plurality of sunken slots correspondingly connected to the third terminal slots; and at least one stretch portion, stretching from another edge of the central portion for accommodating the first insulating housing;

a plurality of first contacts, correspondingly accommodated in the first accommodating slots and the first terminal slots, comprising a pair of first differential signal terminals and each the first contacts comprising:

a first assembling portion;

a first contact portion connected to an end of the first assembling portion; and a first soldering portion connected to another end of the first assembling portion;

a plurality of second contacts, respectively accommodated in the second accommodating slots and the second terminal slots, comprising a pair of second differential signal terminals and a pair of third differential signal terminals and each second contacts comprising:

a second assembling portion;

a second contact portion connected to an end of the second assembling portion; and a second soldering portion connected to another end of the second assembling portion;

a plurality of third contacts respectively accommodated in the third accommodating slots, the third terminal slots and the sunken slots, and each third contact comprising:

a third assembling portion;

a third contact portion connected to an end of the third assembling portion; and a third soldering portion connected to another end of the third assembling portion; and a protrusion protruding from an end of the central portion, opposite the first insulating housing, wherein the second soldering portions are exposed over the protrusion;

wherein the first soldering portions, the second soldering portions and the third soldering portions face a same direction and are respectively exposed over the first terminal slots, the protrusion and the sunken slots in the same direction.

6. The electrical connector of claim 5, further comprising a rear cover engaged with the central portion of the second insulating housing, wherein the rear cover comprises at least one fixing hole, the sunken slots are formed in the rear cover, and the third soldering portions are accommodated in the rear cover and are exposed over the sunken slots.

7. The electrical connector of claim 5, further comprising a metal case, with an accommodating space formed inside the metal case, wherein the first insulating housing, the second insulating housing, the first contacts, the second contacts and the third contacts are accommodated in the accommodating space.

8. The electrical connector of claim 6, further comprising:

a first cable set, comprising two first signal cables, a first grounding cable and a power cable, correspondingly soldered to the first soldering portions;

a second cable set, comprising a pair of first internal cable sets, each internal cable set comprising two second signal cables, a second grounding cable and a shielding layer encompassing the two second signal cables and the second grounding cable, the second grounding cable of the internal cable sets being adjacent to each other and soldered to one of the second soldering portions, the second signal cables being correspondingly soldered to the second soldering portions;

a third cable set, the third cable comprising:

a pair of second internal cable sets, respectively containing two third signal cables, a third grounding cable, and a shielding layer encompassing the two third signal cables and the third grounding cable; and a grounding component, comprising:

a body;

at least one fixing portion disposed at an end of the body; and a plurality of soldering pins vertically bent to extend from a side of the body;

wherein the fixing portion is engaged with the fixing hole in the rear cover, the third signal cables, the third grounding cable and the pins are respectively soldered to the corresponding third soldering portions, one of the soldering pins and one of the third grounding cable are soldered to the same third soldering portion.

9. An assembling method of an electrical connector, comprising:

disposing a plurality of second contacts in a first insulating housing in an insert molding method, wherein the second contacts respectively comprises a second assembling portion, a second contact portion connected to an end of the second assembling portion, and a second soldering portion connected to another end of the second assembling portion;

placing the first insulating housing in a pair of stretch portions of a second insulating housing;

disposing a plurality of first contacts and a plurality of third contacts in the second insulating housing, wherein the first contacts respectively comprises a first assembling portion, a first contact portion connected to an end of the first assembling portion, and a first soldering portion connected to another end of the first assembling portion, the third contacts respectively comprises a third assembling portion, a third contact portion connected to an end of the third assembling portion, and a third soldering portion connected to another end of the third assembling portion;

placing the first insulating housing, the second insulating housing, the first contacts, the second contacts and the third contacts in an accommodating space of a metal case;

soldering a plurality of first signal cables, a first grounding cable and a power cable of a first cable set to the first soldering portions;

soldering a plurality of second signal cables and a plurality of second grounding cables of a second cable set to the second soldering portions, wherein the second grounding cables are soldered to the same second soldering portion; and soldering a plurality of third signal cables, a plurality of third grounding cables and a grounding component of a third cable set to the third soldering portions, wherein the grounding component comprises a body, at least one fixing portion disposed at an end of the body, and a plurality of soldering pins vertically bent to extend from a side of the body, and one of the soldering pins and the one of third grounding cable are soldered to the same third soldering portion.

10. The assembling method of claim 9, further comprising:

disposing a rear cover at an end of the second insulating housing opposite the stretch portion before soldering the first cable set.

11. The assembling method of claim 9, further comprising:

soldering the first cable set and the third cable set respectively to the first soldering portions and the third soldering portions in first direction; and soldering the second cable set to the second soldering portions in second direction opposite to the first direction.

12. The assembling method of claim 9, further comprising:

soldering the first cable set, the second cable set and the third cable set respectively to the first soldering portions, the second soldering portions and the third soldering portions in the same direction, wherein the second insulating housing comprises a protrusion.

* * * * *